US006200045B1

(12) United States Patent
Hahn et al.

(10) Patent No.: US 6,200,045 B1
(45) Date of Patent: Mar. 13, 2001

(54) COMBINATION COSMETICS PACKAGE

(75) Inventors: Stephanie L. Hahn; Joshua M. Rosenbaum, both of Atlanta, GA (US)

(73) Assignee: Stephanie Lee LLC, Atlanta, GA (US)

( * ) Notice: Subject to any disclaimer, the term of this patent is extended or adjusted under 35 U.S.C. 154(b) by 0 days.

(21) Appl. No.: 09/389,909

(22) Filed: Sep. 3, 1999

(51) Int. Cl.[7] ..... B43K 27/02
(52) U.S. Cl. ..... 401/18; 401/17; 401/126
(58) Field of Search ..... 401/18, 17, 16, 401/34, 37, 38, 39, 126; 215/227

(56) References Cited

U.S. PATENT DOCUMENTS 2,736,050 * 2/1956 Lee ..... 401/18
3,103,032 * 9/1963 Brenne ..... 401/18
3,690,777 * 9/1972 Costa ..... 401/18
5,325,980 * 7/1994 Grimm et al. ..... 220/212
5,509,742 * 4/1996 Balzarini ..... 401/18
5,897,262 * 4/1999 Bratby-Carey ..... 401/18

* cited by examiner

*Primary Examiner*—David J. Walczak
(74) *Attorney, Agent, or Firm*—Technoprop Colton LLC

(57) ABSTRACT

A combined cosmetics package for containing cosmetic products, having a first component for containing a first cosmetic product; a second component for containing a second cosmetic product; and a connector cap that is removably attached to the first component for reclosably sealing the first component and is removably attached to the second component for releasably securing the second component to the connector cap, wherein, when the connector cap is removably attached to the first component and removably attached to the second component, the combined cosmetics package results.

15 Claims, 3 Drawing Sheets

COMBINATION COSMETICS PACKAGE

TECHNICAL FIELD

This invention relates generally to the field of packaging, specifically to the field of packaging cosmetic products, and more specifically to the field of packaging cosmetic products that allows the consumer to purchase matching or complimentary but separate cosmetics or cosmetic-related products together as one product.

BACKGROUND OF THE INVENTION

Cosmetics and cosmetic-related products come in a variety of packages and packaging materials. For example, lipstick may be packaged in tubes as a paste or bottles as a liquid, finger nail polish may be packaged in single color containers or multi-color containers. The packaging itself may be glass, plastic, metal or other materials, and the shapes of the packages are as varied as the cosmetics themselves.

For the most part, individual types of cosmetics are sold to the consumer in individual packages. A tube of lipstick, a bottle of finger nail polish, a canister of facial powder, an eyebrow pencil, a bottle of rouge, for example. There are examples of multi-component packaging for cosmetics. However, typically the multi-packs are the same type of cosmetic. Complimentary shades of eyebrow pencil, complimentary shades of eye shadow, and complimentary shades of rouge, for example. Also common are combination packages of a cosmetic product and an accessory. Facial powder combined with a powder puff and a mirror, lipstick combined with an applicator brush, and eye shadow combined with an applicator pad, for example.

To the best of applicants' knowledge, there is not a combination package of the typed disclosed herein that allows for the mixing and matching of two separate cosmetics or cosmetic-related products to form one packaging unit. Finger nail polish and lipstick, lipstick and eye liner, or eye shadow and lipstick, for example. Such a combination cosmetic package would be advantageous both to the cosmetics manufacturer, allowing the sale of two complimentary products in one package, and to the cosmetics user, allowing the purchase and compact transport of two complimentary cosmetic products. It is to this combination cosmetic package that the present specification is directed.

BRIEF SUMMARY OF THE INVENTION

The combined cosmetics package comprises two major components that fit together to form one packaging unit. The first component, a base, is comprised of a bottle, or receptacle, with a cap. The second component, a top, is comprised of a two-part case. One end of the second component fits within a cavity in the cap of the first component. The cavity in the cap of the first component is structured to receive and hold the second component in a releasable manner so as to form the combined cosmetics package.

A first embodiment of the device contemplates the first component being a receptacle for fingernail polish and the second component being a lipstick case. In this first embodiment, the base of the first component is structured to be a bottle capable of containing a liquid, that being the finger nail polish, and the second component is structured to be a typical lipstick case. The cap of the first component can screw onto the base of the first component, forming a closable bottle for containing the finger nail polish. The top end of the cap of the first component comprises the cavity, which is structured to receive the second component, that being the lipstick case.

A second embodiment of the device contemplates the first component being a receptacle for eye shadow and the second component being a case capable of containing eye liner pencils or the like. In this second embodiment, the base of the first component is structured to be a bottle capable of containing a powder, that being the eye shadow, and the second component is structured to be a hollow case capable of containing eye liner pencils. The cap of the first component can screw onto the base of the first component, forming a closable bottle for containing the eye shadow. The top end of the cap of the first component comprises the cavity, which is structured to receive the second component, that being the eye liner pencil case.

A third embodiment of the device contemplates the first component being a receptacle for foundation and the second component being a case capable of containing rouge or the like. In this third embodiment, the base of the first component is structured to be a bottle capable of containing a liquid or paste, that being the foundation, and the second component is structured to be a hollow container capable of being filled with rouge. The cap of the first component can screw onto the base of the first component, forming a closable bottle for containing the foundation. The top end of the cap of the first component comprises the cavity, which is structured to receive the second component, that being the rouge container.

The device further can comprise a releasable locking means for holding the first component and the second component together in a secure, yet releasable, manner. For example, the cavity of the cap of the first component can comprise a raised ring about its internal perimeter and the second component can comprise a shallow indented or recessed ring about its external perimeter. The raised ring and the recessed ring cooperate with each other as a locking mechanism, with the raised ring fitting within the recessed ring when the second component is placed within the cavity of the cap of the first component.

Many other embodiments are contemplated and will become evident to those of ordinary skill in the art. Using the general structure disclosed herein, it will become apparent that many different cosmetics or cosmetic-related products can be contained in sets of two by the present invention.

An object of the present invention is to provide a combined cosmetics package capable of containing two cosmetic or cosmetic-related products in which each cosmetic or cosmetic-related product is contained in a separate part of the combined package, allowing the consumer to mix and match cosmetic products.

Another object of the present invention is to provide a combined cosmetics package capable of containing two cosmetic or cosmetic-related products in which each cosmetic or cosmetic-related product is contained in a separate part of the combined package, allowing the cosmetic manufacturer to provide two different and/or complimentary products to the consumer.

Another object of the present invention is to provide a combined cosmetics package that can be easily configured to contain two or more of many different types of cosmetics or cosmetic-related products.

Another object of the present invention is to provide a combined cosmetics package that comprises separable components that can be used independent of one another.

Another object of the present invention is to provide a combined cosmetics package that comprises separable components that fit securely together so as to make a unitary package.

Another object of the present invention is to provide a combined cosmetics package that is simple to use, economic to manufacture, and appealing to the consumer.

These objects, and other objects, features and advantages of the present invention, will become apparent to one of ordinary skill in the art when the following detailed description of the preferred embodiments is read in conjunction with the attached figures, in which like reference numerals represent like components throughout the several views.

DETAILED DESCRIPTION OF PREFERRED EMBODIMENTS

Figure 1:
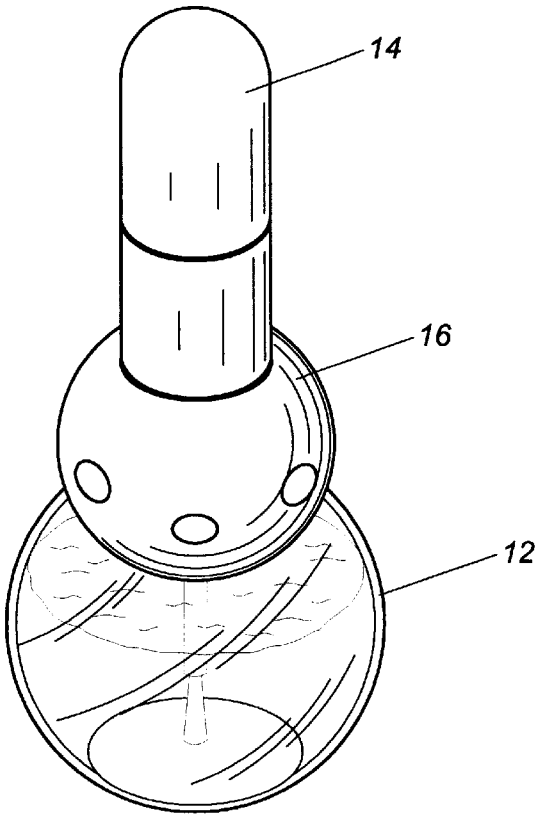
FIG. 1 is a perspective view of a first preferred embodiment of the invention.

A first preferred embodiment of the combined cosmetics package 10 is shown in FIG. 1. The package 10 in general comprises a first component 12, a second component 14 and a connector cap 16. Second component 14 further comprises two parts, a first end 14*a* which typically is fitted and a second end 14*b* which typically is not fitted. When first component 12, second component 14 and cap 16 are fitted together, the combined cosmetics package 10 is formed.

Figure 2:
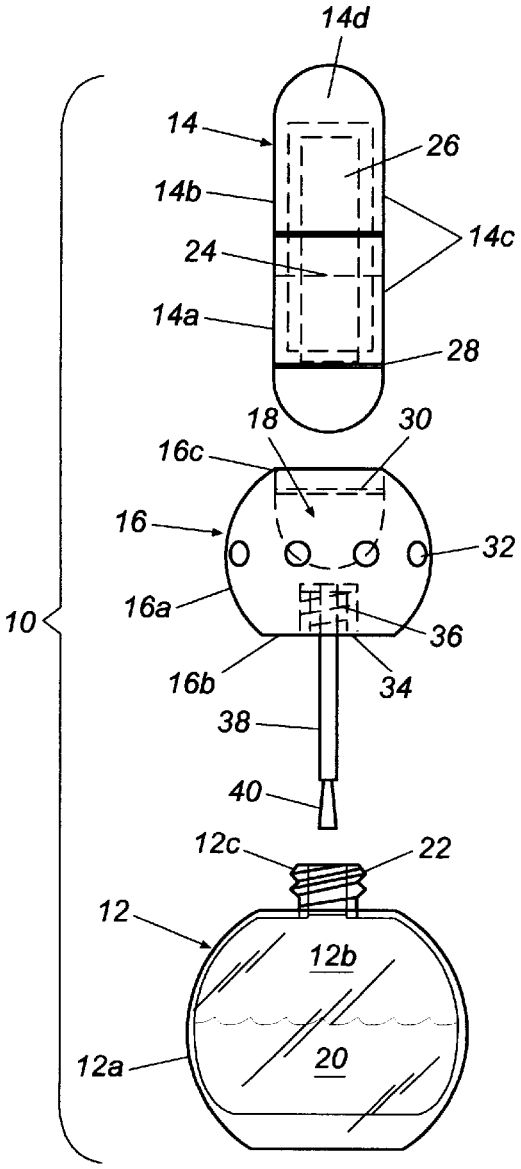
FIG. 2 is an exploded sectional side view of the preferred embodiment of FIG. 1.
Figure 3:
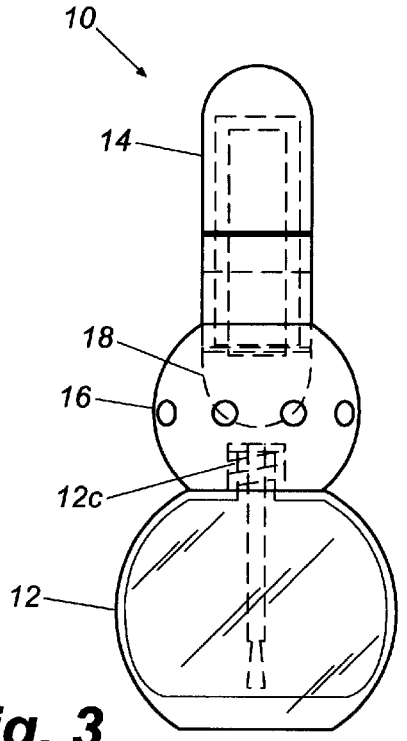
FIG. 3 is a sectional side view of the preferred embodiment of FIG. 1.

Referring now to FIGS. 2 and 3, the package 10 is shown in more detail. The combined cosmetics package 10 comprises two major components that fit together to form one packaging unit. The first component 12, a base, is comprised of a bottle, or receptacle, with a cap 16. The second component 14, a top, is comprised of a two-part case 14*a*, 14*b*. One end of the second component 14 fits within a cavity 18 in the cap 16. The cavity 18 in the cap 16 is structured to receive and hold the second component 14 in a releasable manner so as to form the combined cosmetics package 10.

First component 12 preferably is a more or less common bottle structure comprising a side wall 12*a*, an interior volume 12*b* and a top opening 12*c*. First component 12 typically acts as the base for the package 10 and, therefore, preferably has a flat bottom. As shown in FIG. 2, first component 12 contains a liquid, such as finger nail polish 20. Opening 12*c* allows access to the interior 12*b* of first component 12 and preferably comprises a sealing mechanism such as screw threads 22 for cooperating with cap 16 to close and seal the opening 12*c*. As shown in FIG. 2, first component 12 is a transparent material such as glass or plastic, but it should be noted that the material of which first component 12 is made is of minor consequence so long as the material is capable as serving as a reclosable container for cosmetics. Glass, plastic, metal, porcelain and other ceramics, and even wood are all suitable materials.

Second component 14 preferably is a more or less cylindrical hollow structure comprising a first end 14*a* and a second end 14*b*. When together, first end 14*a* and second end 14*b* comprise a side wall 14*c* and an interior volume 14*d*. A portion of second end 14*b* fits within a portion of first end 14*a* to form the closed second component 14. Dashed line 24 indicates the lower extent of second end 14*b* contained within first end 14*a*. Although a friction fit between first end 14*a* and second end 14*b* is preferred, other means of closure, such as screw threads, hinge and clasps, and ridge and valley closures are suitable. As shown in FIG. 2, second component 14 is structured to contain lipstick 26. In this embodiment, second component 14 has the general mechanical structures of a common lipstick tube, including the twisting mechanism (not shown) to move the lipstick up and down within the second component 14. The material of which second component 14 is made is of minor consequence so long as the material is capable as serving as a reclosable container for cosmetics. Glass, plastic, metal, porcelain and other ceramics, and even wood are all suitable materials.

Second component 14 further comprises a means to releasably secure second component 14 to cap 16. As shown in FIG. 2, the means to releasably secure second component 14 to cap 16 preferably comprises a recessed ring 28 about the perimeter of side wall 14*c*. As discussed in more detail below, recessed ring 28 cooperates with raised ring 30 of cap 16 to releasably secure second component 14 within cavity 18. Although a recessed ring 28 and raised ring 30 means is shown, this is for illustrative purposes only, and other securing means are suitable. For example, second component 14 may be held within cavity 18 by a friction fit only, by magnetism, by recessed dimples and raised dimples, by a screw thread, by channels, by twist and lock channels, by sloped ridges and shoulders and the like. Additionally, the recessed portions can be either on second component 14 or cap 16,with the cooperating raised portions being on cap 16 or component 14, respectively.

Connector cap 16 preferably is a structure comprising a sidewall 16*a*, a bottom end 16*b* and a top end 16*c*. Sidewall 16*a* can be of any desired shape and is used for gripping by the user. Various ornamentations, such as design 32, can be on sidewall 16*a*. Bottom end 16*b* cooperates with first component 12 to provide a closing means for first component 12. Preferably, bottom end 16*b* comprises a recess 34 that cooperates with opening 12*c*. As shown in FIG. 2, recess 34 comprises screw threads 36 that cooperate with screw threads 22. When cap 16 is placed over first component 12, recess 34 fits over opening 12*c*, and screw threads 36 engage screw threads 22. Cap 16 is twisted and opening 12*c* is covered and closed by recess 34.

Top end 16*c* cooperates with second component 14 to provide a securing means for second component 14. Top end 16*c* comprises cavity 18 that cooperates with first end 14*a*. As shown in FIG. 2, cavity 18 comprises raised ring 30 that cooperates with recessed ring 28. When second component 14 is placed within cavity 18, raised ring 30 fits within recessed ring 28 and holds second component 14 within cavity 18 in a releasable manner. Cavity 18 is structured to complement the shape of first end 14*a*. As shown in FIG. 2, both cavity 18 and first end 14*a* have a generally round shape. However, shape is of minor consequence, and both first end 14*a* and cavity 18 can have different shapes, such as ovals, squares, V-shapes and the like. The material of which cap 16 is made is of minor consequence so long as the material is capable of sufficient strength and elasticity to carry screw threads or the equivalent, and to provide a raised or recessed ridge or ring. Glass, plastic, metal, porcelain and other ceramics, and even wood are all suitable materials.

Figure 4:
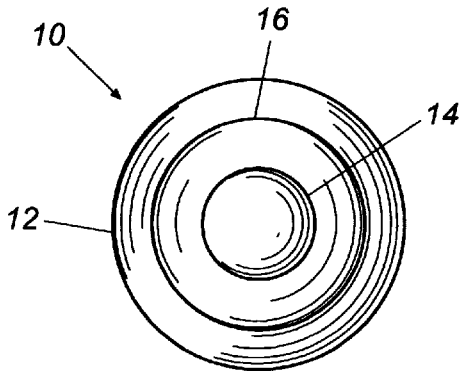
FIG. 4 is a top view of the preferred embodiment of FIG. 1.
Figure 7:
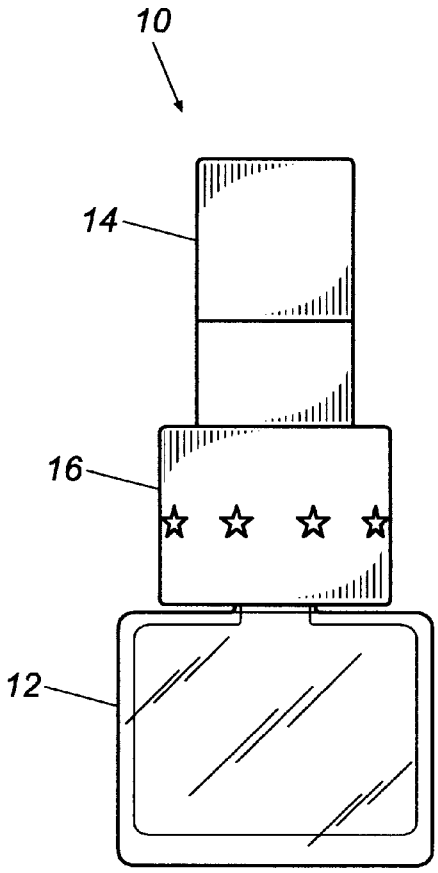
FIG. 7 is a side view of a first alternate external design configuration of the present invention.
Figure 8:
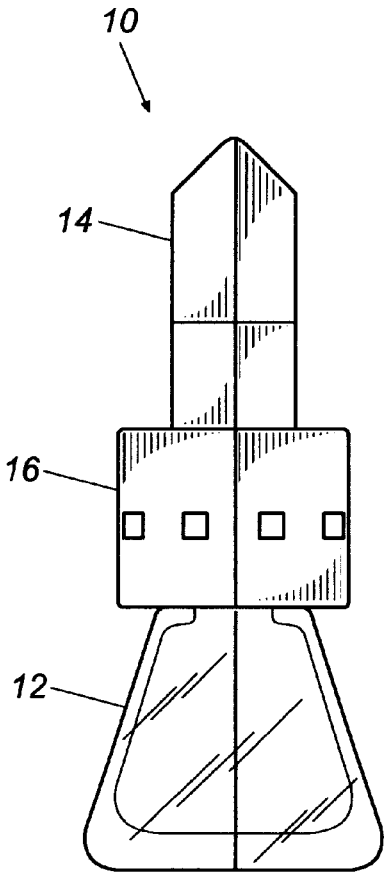
FIG. 8. Is a side view of a second alternate external design configuration of the present invention.

FIG. 3 shows a side view of package 10 as a unit. Second component 14 is fitted within cavity 18 of cap 16, and cap 16 is secured over opening 12*c* of first component 12. FIG. 4 shows a top view of package 10 as a unit, and illustrates one shape of package 10 as a whole. As shown in FIGS. 7 and 8, package 10 does not have to be round, but may be of any shape, including squares and triangles.

A first embodiment of the package 10, as shown in FIG. 2, contemplates the first component 12 being a receptacle for fingernail polish 20 and the second component 14 being a lipstick 26 case. In this first embodiment, first component 12 is structured to be a bottle capable of containing a liquid, that being the finger nail polish 20, and second component 14 is structured to be a typical lipstick case. Cap 16 can screw onto opening 12*c* of first component 12, forming a closable bottle for containing the finger nail polish 20. The top end 16*c* of cap 16 comprises cavity 18, which is structured to receive second component 14, that being the lipstick case. An applicator 38 ending in a brush 40 is secured within recess 34 for use in applying finger nail polish 20.

Figure 5:
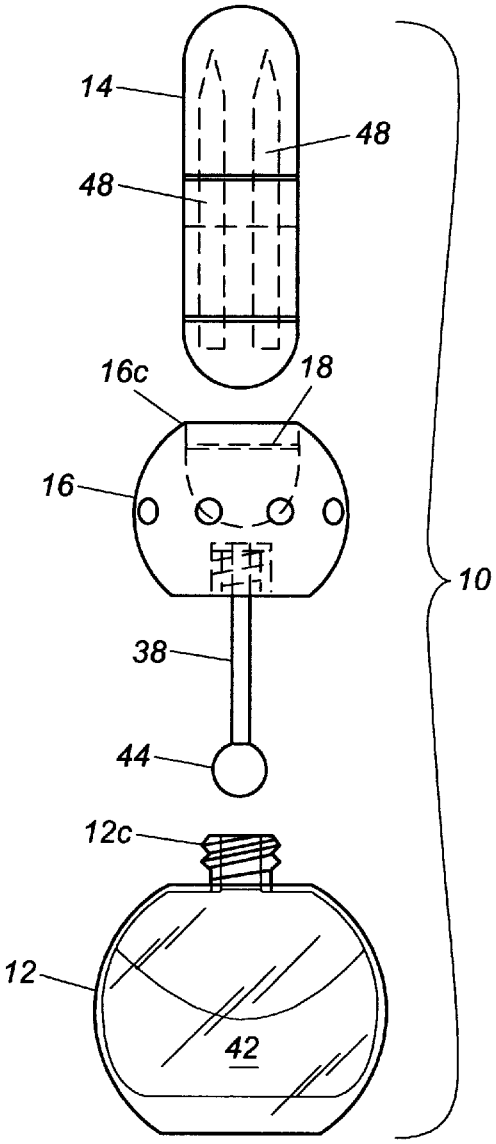
FIG. 5 is an exploded sectional side view of a second preferred embodiment of the invention.

A second embodiment of the package 10, as shown in FIG. 5, contemplates the first component 12 being a receptacle for eye shadow 42 and the second component 14 being a case capable of containing eye liner pencils 48 or the like. In this second embodiment, first component 12 is structured to be a bottle capable of containing a powder, that being the eye shadow 42, and second component 14 is structured to be a hollow case capable of containing eye liner pencils 48. Cap 16 can screw onto opening 12*c* of first component 12, forming a closable bottle for containing the eye shadow 42. Top end 16*c* of cap 16 comprises cavity 18, which is structured to receive second component 14, that being the eye liner pencil 48 case. An applicator 38 ending in a pad 44 is secured within recess 34 for use in applying eye shadow 42.

Figure 6:
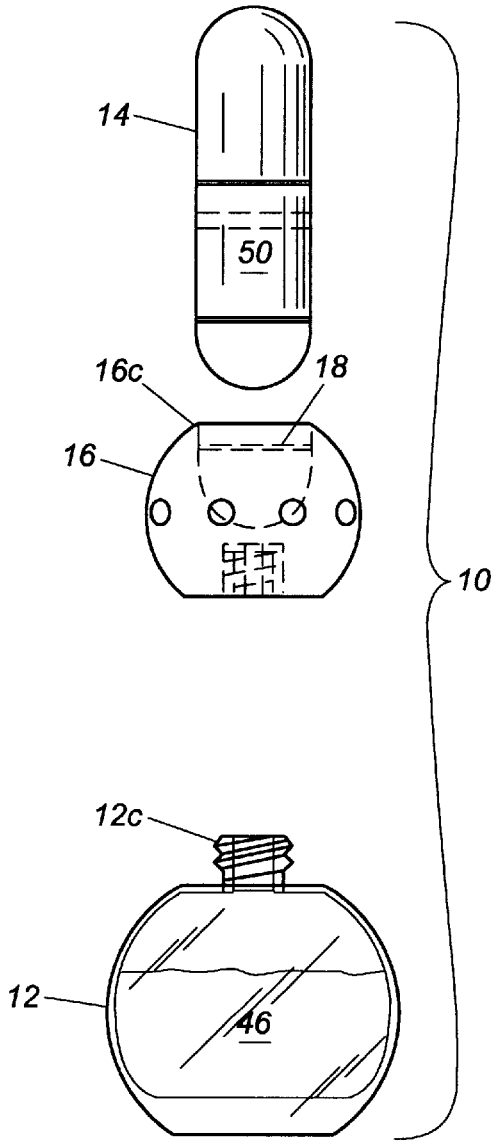
FIG. 6 is an exploded sectional side view of a third preferred embodiment of the invention.

A third embodiment of the package 10, as shown in FIG. 6, contemplates first component 12 being a receptacle for foundation 46 and second component 14 being a case capable of containing rouge 50 or the like. In this third embodiment, first component 12 is structured to be a bottle capable of containing a liquid or paste, that being the foundation 46, and second component 14 is structured to be a hollow container capable of being filled with rouge 50. Cap 16 can screw onto the opening 12*c* of first component 12, forming a closable bottle for containing the foundation 46. Top end 16*c* of cap 16 comprises cavity 18, which is structured to receive second component 14, that being the rouge container. In this third embodiment, an applicator is not necessary, as the first component 12 is merely tipped to allow the foundation 46, which typically is a liquid, to pour onto a fingertip.

The design of the package 10 can be customized as to shape, material of construction, color and proportion, so long as the general configuration of the major components, those being the first component 12, the second component 14, and the cap 16, remains the same. Ornamental features, such as ornamentations 32, also can be customized both in shape and n placement on the package 10.

The preferred use of the package 10 is in the cosmetics industry. As disclosed above, first component 12 and second component 14 can contain any of a variety of cosmetic products, in a variety of configurations. The potential uses of the package 10 are broad and the embodiments disclosed herein are for illustrative purposes only and not to limit the scope of the invention and its equivalents as defined by the appended claims.

What is claimed is:

1. A combination cosmetics package for containing cosmetic products, comprising:

a. a first component for containing a first cosmetic product;

b. a connector cap that is removably attached to the first component for reclosably sealing the first component; and c. a second component for containing a second cosmetic product and which is releasably secured within the connector cap, wherein, said second component is a stand-alone independent hollow enclosed structure comprising a first end and a second end that, when connected together, form a side wall and an interior volume; a portion of the second end fits within a portion of the first end to form the second component; the second component contains lipstick and the second component further comprises a lipstick tube; and when the connector cap is removably attached to the first component and releasably secured to the second component, the combination cosmetics package results.

2. The package characterized in claim 1, wherein the first component is a bottle structure comprising a side wall, an interior volume, and a top opening.

3. The package characterized in claim 2, wherein the connector cap is a structure comprising a sidewall, a bottom end, and a top end.

4. The package characterized in claim 3, wherein the bottom end of the connector cap cooperates with the top opening of the first component to provide a reclosable closing means for the first component.

5. The package characterized in claim 3, wherein the top end of the connector cap cooperates with the first end of the second component to releasably secure the second component into the connector cap.

6. The package Characterized in claim 5, wherein the top end of the connector cap comprises a cavity that cooperates with the first end of the second component to releasably secure the second component into the connector cap.

7. The package characterized in claim 2, wherein the first component further comprises a flat bottom.

8. The package characterized in claim 2, wherein the top opening allows access to the interior volume of the first component.

9. The package characterized in claim 8, wherein the top opening comprises a sealing means that cooperates with the connecting cap to close and seal the top opening.

10. The package characterized in claim 1, wherein the first component is constructed from a material selected from the group consisting of glass, plastic, metal, ceramics, and wood.

11. The package characterized in claim 1, wherein the material of which the second component is made is selected from the group consisting of glass, plastic, metal, ceramics, and wood.

12. The package characterized in claim 1, wherein the second component further comprises a means to releasably secure the second component to the connecting cap.

13. The package characterized in claim 1, wherein the material of which the cap is made is selected from the group consisting of glass, plastic, metal, ceramics, and wood.

14. A combined cosmetics package for containing cosmetic products, comprising:

a. a first component for containing a first cosmetic product, the first component being a bottle structure comprising a side wall, an interior volume for containing a cosmetic product, and a top opening allowing access to the interior volume of the first component;

b. a second component for containing a second cosmetic product, the second component being a stand-alone independent hollow enclosed structure comprising a first end and a second end that, when connected together, form a side wall and an interior volume for containing a cosmetic product; and c. a connector cap that is removably attached to the first component for reclosably sealing the first component and is removably attached to the second component for releasably securing the second component to the connector cap, the connector cap being a structure comprising a bottom end, and a top end, wherein, the second component contains lipstick and the second component further comprises a lipstick tube, and when the bottom end of the connector cap is removably attached to the opening of the first component and the top end of the connector cap is removably attached to the first end of the second component, the combined cosmetics package results.

15. The package characterized in claim 14, wherein the top opening comprises a reclosable sealing means that cooperates with the connecting cap to close and seal the top opening and the second component is releasably secured to the connecting cap.

* * * * *